US008257147B2

(12) United States Patent
Summers et al.

(10) Patent No.: US 8,257,147 B2
(45) Date of Patent: Sep. 4, 2012

(54) METHOD AND APPARATUS FOR JET-ASSISTED DRILLING OR CUTTING

(75) Inventors: David Archibold Summers, Rolla, MO (US); Klaus Hubert Woelk, Rolla, MO (US); Kenneth Doyle Oglesby, Tulsa, OK (US); Grzegorz Galecki, Rolla, MO (US)

(73) Assignees: Regency Technologies, LLC, Tulsa, OK (US); The Curators of the University of Missouri, Rolla, MO (US)

( * ) Notice: Subject to any disclaimer, the term of this patent is extended or adjusted under 35 U.S.C. 154(b) by 702 days.

(21) Appl. No.: 12/400,507

(22) Filed: Mar. 9, 2009

(65) Prior Publication Data

US 2009/0227185 A1 Sep. 10, 2009

Related U.S. Application Data

(60) Provisional application No. 61/068,935, filed on Mar. 10, 2008.

(51) Int. Cl.
*B24B 1/00* (2006.01)

(52) U.S. Cl. ..... 451/38; 451/39; 451/40

(58) Field of Classification Search ..... 451/38, 451/40, 99, 102, 53, 449; 239/433; 175/65, 175/71, 54, 424, 380; 166/67, 54
See application file for complete search history.

(56) References Cited

U.S. PATENT DOCUMENTS

| | | | | |
|---|---|---|---|---|
| 2,125,445 | A | | 8/1938 | Holveck |
| 2,640,545 | A | | 6/1953 | Share |
| 3,189,107 | A | | 6/1965 | Galle |
| 3,508,621 | A | * | 4/1970 | Gaylord et al. ..... 175/67 |
| 3,528,704 | A | | 9/1970 | Johnson, Jr. |
| 3,713,699 | A | | 1/1973 | Johnson, Jr. |
| 4,392,534 | A | | 7/1983 | Miida |
| 4,474,331 | A | | 10/1984 | Aprea et al. |
| 4,497,664 | A | | 2/1985 | Verry |
| 4,534,427 | A | | 8/1985 | Wang et al. |
| 4,535,576 | A | * | 8/1985 | Shukla et al. ..... 451/78 |
| 4,542,798 | A | | 9/1985 | Madigan |
| 4,552,786 | A | | 11/1985 | Berneburg et al. |
| 4,787,465 | A | | 11/1988 | Dickinson, III et al. |
| 4,798,339 | A | | 1/1989 | Sugino et al. |
| 4,813,611 | A | | 3/1989 | Fontana |
| 4,817,342 | A | * | 4/1989 | Martin et al. ..... 451/90 |
| 4,852,668 | A | | 8/1989 | Dickinson, III et al. |
| 5,184,434 | A | * | 2/1993 | Hollinger et al. ..... 451/36 |
| 5,283,985 | A | * | 2/1994 | Browning ..... 451/38 |
| 5,291,957 | A | | 3/1994 | Curlett |
| 5,293,946 | A | | 3/1994 | Besson et al. |
| 5,421,766 | A | * | 6/1995 | Shank, Jr. ..... 451/75 |

(Continued)

FOREIGN PATENT DOCUMENTS

| | | |
|---|---|---|
| EP | 0370709 | 5/1990 |

(Continued)

*Primary Examiner* — George Nguyen

(74) *Attorney, Agent, or Firm* — Head, Johnson & Kachigian P.C.

(57) ABSTRACT

An abrasive cutting or drilling system, apparatus and method, which includes an upstream supercritical fluid and/or liquid carrier fluid, abrasive particles, a nozzle and a gaseous or low-density supercritical fluid exhaust abrasive stream. The nozzle includes a throat section and, optionally, a converging inlet section, a divergent discharge section, and a feed section.

17 Claims, 4 Drawing Sheets

U.S. PATENT DOCUMENTS 5,441,441 A * 8/1995 Cook et al. ..... 451/36
5,566,760 A 10/1996 Harris
5,601,153 A 2/1997 Ensminger et al.
5,616,067 A * 4/1997 Goenka ..... 451/39
5,704,825 A * 1/1998 LeCompte ..... 451/102
5,733,174 A 3/1998 Bingham et al.
5,771,984 A 6/1998 Potter et al.
5,862,871 A 1/1999 Curlett
5,897,062 A 4/1999 Enomoto et al.
5,944,581 A * 8/1999 Goenka ..... 451/39
5,975,996 A * 11/1999 Settles ..... 451/102
5,989,355 A * 11/1999 Brandt et al. ..... 134/6
6,283,833 B1 * 9/2001 Pao et al. ..... 451/40
6,347,675 B1 2/2002 Kolle
6,478,879 B1 * 11/2002 Jackson ..... 134/7
6,668,948 B2 12/2003 Buckman, Sr. et al.
6,699,109 B1 * 3/2004 Fox et al. ..... 451/92
6,742,603 B2 6/2004 Polizzotti et al.
6,773,473 B2 8/2004 Kinisky et al.
6,811,471 B2 * 11/2004 Beaudoin ..... 451/41
6,824,086 B1 11/2004 Mazurkiewicz et al.
6,852,011 B2 * 2/2005 Gabzdyl et al. ..... 451/38
6,920,945 B1 7/2005 Belew et al.
6,929,199 B1 * 8/2005 Garg et al. ..... 241/1
6,991,045 B2 1/2006 Vinegar et al.
7,011,158 B2 3/2006 Davis et al.
7,111,692 B2 9/2006 Hosie et al.
7,186,167 B2 * 3/2007 Joslin ..... 451/38
7,306,042 B2 12/2007 Bansal et al.
7,344,573 B2 3/2008 Vecchiarelli et al.
7,775,856 B2 * 8/2010 Bhatnagar et al. ..... 451/38
2003/0207655 A1 * 11/2003 Jackson ..... 451/38
2003/0228738 A1 12/2003 Beaudoin
2004/0088926 A1 5/2004 Kinisky et al.
2005/0101237 A1 5/2005 Vecchiarelli et al.
2006/0016624 A1 1/2006 Tibbitts
2008/0093125 A1 4/2008 Potter et al.

FOREIGN PATENT DOCUMENTS

WO WO2007/112387 10/2007
WO WO2008/027506 3/2008

* cited by examiner

METHOD AND APPARATUS FOR JET-ASSISTED DRILLING OR CUTTING

CROSS-REFERENCE TO RELATED APPLICATIONS

This application claims priority to U.S. Provisional Application No. 61/068,935, filed Mar. 10, 2008, which is herein incorporated by reference.

GRANT STATEMENT

The invention was made in part from government support under Grant No. DE-FC26-04NT15476 from the Department of Energy. The U.S. Government has certain rights in the invention.

BACKGROUND OF THE INVENTION

1. Field of the Invention

The present invention relates to a method and apparatus for cutting into and drilling through materials in general. More specifically, the present invention relates to a method and apparatus for cutting into and drilling through materials using the liquid, gaseous and/or supercritical phase of a fluid along with certain solid abrasive materials.

2. Prior Art

Jet assisted drilling for drilling horizontal holes, primarily for oil and gas wells, has been attempted since at least the 1960s, but required high-pressure to increase penetration rates. High-pressure fluid jet-assisted drilling has also been studied, such as using water jets positioned close to the cutting teeth of conventional bits to improve their penetration rate. While effective, the high-pressure fluid jet-assisted drilling technique still requires a means to transmit both force and high pressure fluid to the drilling bit, and thereby makes the supporting drill rod stiffer and more difficult to turn. In addition, each of the hundreds of tool joints that are assembled into the drilling string of pipe must be fully sealed against one another, as the pipe is assembled, in order to effectively deliver the high pressure fluid to the bit while concurrently delivering sufficient torque and stiffness to the bit as to drive it forward into the rock.

To improve the performance of a drilling jet stream, certain small abrasive particles have been introduced into the drilling fluid (mainly water based). By so doing, and configuring the system so that there is an energy transfer between the pressurized fluid and the particles, the particles can be given sufficient kinetic energy that they will cut into the target material ahead of the drill bit. Energy transfer from the water to the particles is, however, inefficient, so that the particles gain only a fraction of the velocity that the liquid jet would have without them. The combination of high velocity solid particles in liquid allows the potential for drilling through the hardest material, provided that the supply pressure to the water is high enough to overcome the low energy transfer efficiency, and that the kinetic energy imparted to the abrasive particles exceeds that required to break the targeted material. Currently, several abrasive water jet systems have been developed based on this method. The requirement of a very high water pressure to cut some rock targets is problematic, especially when the drill is attached to the end of a coiled-tube system, since the thin wall of such a pipe can only safely carry a certain pressure and still perform its function.

One of the important components in the abrasive water jet system is the cutting nozzle. The cutting nozzle designs that have been used for conventional high-pressure water jet drilling are designed typically with a converging conic section of around 12-20 degrees leading into a narrow bore (on the order of 0.04 inches diameter) of short length (nominally around 4-10 times bore diameter), as shown in FIG. 1. The design intends to accelerate the water jet stream to a maximum velocity before being directed at the target material.

When high-pressure jets are used in other applications, it is on occasion advantageous that the water jet be dispersed to cover a larger area. There are a number of different ways in which the flow of fluid from a nozzle orifice can be disrupted, so that it covers a larger area. One method to broaden the resulting exit stream of the water jet is to place turning vanes in the section of the nozzle immediately upstream of the section where the diameter narrows. If this is done, and water injected through it, then the swirling action of the water jet stream can induce cavitation in the central section of the resulting water jet stream, with the collapse of the cavitation cloud enhancing cutting performance, but still at a relatively slow penetration rate. This work has been described by Johnson and Conn of Hydronautics and described in U.S. Pat. Nos. 3,528,704 and 3,713.699. A similar use of turning vanes, placed immediately upstream of the nozzle, has been used by companies such as Steinen and Spraying Systems, wherein the resulting water jet is allowed to egress into the atmosphere where it spreads to cover a large circular area, which has benefits in cleaning such surfaces as it might be directed against. The latter systems do not have sufficient power, as normally applied, to be able to cut into rock and similar target material.

A concern with the performance of an abrasive water jet stream for drilling comes from the interference to free passage that occurs in the interaction of particles and water entering the cutting zone at the target, with the spent fluid, abrasive and removed rock leaving that zone. This is compounded when the jet is very narrow and cutting a very thin slit into the target surface. Efficiencies of cutting are also constrained by a need to ensure that all the rock (or other target materials and debris) ahead of the drill has been removed over the full diameter of the face of the drilling tool, by directing a jet or jets to impact that full area, before the nozzle advances further into the rock (or other target). Without that full removal of material over the full face, the nozzle cannot advance past that remaining obstruction. Concurrently, in developing a design for a light, portable and simple drill, the need for a rotation system to ensure that abrasive jets fully sweeps the area ahead of the nozzle and drill assembly to remove any impeding rock, adds considerable complexity, cost and weight to the unit.

Currently, jet assisted drilling using supercritical fluid or dense gas, such as carbon dioxide, as a drilling fluid has been investigated, such as with the coiled tubing drilling method and apparatus described in U.S. Pat. No. 6,347,675 to Kollé. The method in U.S. Pat. No. 6,347,675 uses either a supercritical fluid or a dense gas (such as carbon dioxide, methane, natural gas, or a mixture of those materials) as a drilling fluid. To maintain the drilling fluid in its supercritical phase, the method requires the pressure to exceed 5 MPa (preferably, to exceed 7.4 MPa with $CO_2$), which can be achieved only by employing heavy walled drill pipe and special connections. Also, a surface choke manifold at the drill site is required to control the resultant return flow. Alternately, the drilling process can be controlled by "capping" the well with drilling mud. This process uses additives in the drilling fluid to increase the density of that fluid, which fills the annulus between the drilling tube and the surrounding rock wall. This passage is the return path, through which the cuttings must pass to reach the surface and clear the hole. By increasing the down-hole pressure around the drilling bit, however, a higher driving pressure is required to effectively cut into the rock target, that may well be in the range from 50 to 200 MPa and this exceeds the pressure capability of most coiled tubing. Also, the presence of this higher density fluid provides a more resistive barrier to the jet motion. In passing through this barrier the performance of the jet is degraded, and a poor cutting ability in penetrating the target rock results.

Potter et al. (U.S. Pat. No. 5,771,984) discloses spallation or thermal processes for weakening the rock by heat. The gases and fluids injected are for combustion to form hot fluids to perform the disclosed process without adding solids to the injected stream. All return flow is specifically within and up the drill pipe. In contrast, the present invention disclosed herein uses erosive cutting or abrasive cutting by use of a slurry wherein solids are suspended in the liquid (which is normally gas in a liquid state). Additionally, return flow can travel up to the surface outside of the drill pipe.

Bingham et al. (U.S. Pat. No. 5,733,174) provides a system using supercritical or liquified gases as the carrier fluid. Solids are the supercritical gas in a solid form. The solids are neither hard nor dense resulting in inefficient cutting. In contrast to the present invention, Bingham et al. does not flash the supercritical carrier liquid into a gas either inside or just outside the nozzle. Bingham requires a central slurry jet of supercritical liquid and supercritical solid and an outer sheet of supercritical liquid and an outer gas.

Therefore, there remains a need to provide a set of new and improved jet-assisted drilling and/or cutting method and apparatus that performs targeted drilling or cutting, with high efficiency, increased speed, easy advancing of the device, and ready removal of drilling/cutting debris, and lower pressure operation.

SUMMARY OF THE INVENTION

In one aspect of the invention, a novel jet-assisted drilling/cutting method utilizing a supercritical fluid/liquid carrying abrasive solids as a drilling or cutting fluid to increase efficiency and ease of removal of the drilling/cutting debris during a drilling or cutting operation is described. According to one embodiment of the invention, the inventive drilling or cutting method comprises 1) providing an abrasive-laden supercritical fluid/liquid under a pre-determined pressure, whereas said abrasive-laden supercritical fluid/liquid comprising a suspension of pre-selected abrasive solids in a supercritical fluid/liquid, 2) delivering said abrasive-laden supercritical fluid/liquid to an entrance point of a cutting nozzle capable of accelerating said abrasives, whereas existing from said cutting nozzle, said abrasive-laden supercritical fluid/liquid is discharged as an abrasive jet stream carried by gas, and 3) directing the abrasive jet stream at a target substance.

When the inventive method is employed in a deep earth drill operation, the abrasive-laden supercritical fluid/liquid may be discharged as an abrasive jet stream carried by a low-density supercritical fluid or mixture of gas and low-density supercritical fluid. An optional step of controlling pressure and/or temperature at discharge may be added in the aforesaid method, when employed in an operation, to ensure said carrier liquid expands fully into its gas phase.

Other liquids or chemicals can be added to the mixture stream before the nozzle.

According to one embodiment of the inventive method, the target substance can be any naturally occurring material, such as barium sulfate or calcium sulfate, any man-made material including steel, steel alloys, any combination of naturally occurring and man-made materials, such as barium sulfate or calcium sulfate deposits on man-made materials, or any other hardened materials. The target substance can be on the surface, such as for surface cutting and cleaning of materials, or under the surface.

According to another embodiment, the target can be but is not limited to geological rock, sandstone, limestones, basalt or volcanic flows, as found on or in the Earth or other planets or other bodies in space. The special cutting operation may be called drilling, and the target substance can be located under the planetary surface. Such drilling operations require the advancement of a cutting edge or nozzle through a full diameter cut in the rock preceding it. The specialized cutting or drilling operation may continue for many thousands of feet until the desired depth or location is reached.

In another aspect of the invention, a novel cutting nozzle for jet-assisted drilling or cutting apparatus, where an abrasive-laden supercritical fluid/liquid may be accelerated and expanded into its gas phase or low-density supercritical fluid, is described. According to one embodiment of the invention, the inventive nozzle for generating desired abrasive jet stream comprises: 1) an inlet converging conic section, with about 5 to 90 degree convergence, for admitting an abrasive-laden supercritical fluid/liquid and increasing the velocity of said abrasive-laden supercritical fluid/liquid, 2) a narrow diameter aperture throat section, with a diameter of about 0.5 mm to 10 mm and a length of about 3.0 mm to 8 cm, depending on the overall flow rate and pressure desired in an operation, and 3) a diverging conic discharging section, with about 5 to 90 degree divergence, whereby said supercritical fluid/liquid optimally transitions into its gas phase, is constrained in its expansion, and is directed in its path forward onto the target surface ahead of the nozzle. These nozzle sections can be combined so that the inlet converging conic section leads to the narrow diameter aperture throat section, this further leads to said diverging conic discharging section.

According to another embodiment of the invention, the inventive cutting nozzle may be incorporated into a nozzle assembly with a feeding section attached into or part of or preceding the inlet converging conic section of the cutting nozzle. The feeding section may further include a plurality (such as a pair, or multiplicity) of blades at a pre-arranged angle to tangentially induce a spinning vortex to the velocity of the abrasive-laden supercritical fluid/liquid before admitted into the cutting nozzle and to further widen the abrasive jet stream discharged from the cutting nozzle.

According to one embodiment of the invention, the upstream nozzle conditions, such that the fluid remains a liquid or dense supercritical phase, are carefully monitored and controlled. This can be done by sizing the diameter and length of the nozzle throat section, selection of fluids and control of the pump speed to maintain the flow rate sufficiently high. Control of the upstream temperature can also be accomplished by refrigeration or cooling of the inlet or pumped fluids.

According to another embodiment of the invention, the nozzle discharge conditions, such as the discharge pressure and temperature, are carefully controlled. Minimizing restrictions to flow thereby lowers the discharge pressure; alternatively heating the nozzle and passing internal fluids may raise the exhaust temperature. Both control methods are to encourage instant gas or low-density supercritical-fluid formation in the nozzle or at discharge.

DETAILED DESCRIPTION OF THE PREFERRED EMBODIMENTS

Figure 1:
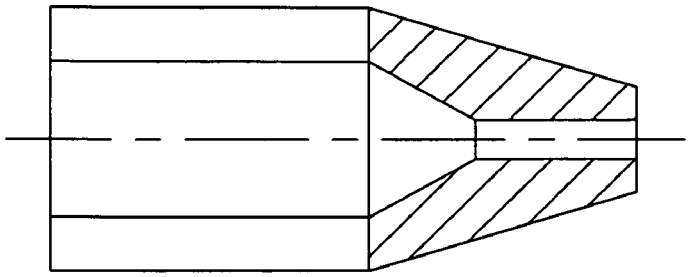
FIG. 1 illustrates the cutting nozzle design according to prior art.

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's constriction and the arrangement of its components without departing from the spirit and scope of this disclosure. It is understood that the invention is not limited to the embodiments set forth herein for purposes of exemplification.

Unless otherwise defined, all technical and scientific terms used herein have the same meaning as commonly understood by one of ordinary skill in the art to which this invention belongs. All publications, patent applications, patents, and other references mentioned herein are incorporated by reference in their entirety.

The present invention employs supercritical fluids/liquids (or the combination thereof) in combination with abrasive solids in a cutting or drilling operation. A supercritical fluid is defined as a phase of matter when the matter is kept above its critical temperature and critical pressure. For example, at room temperature and pressure, carbon dioxide ($CO_2$) is a gas, but at the same temperature transitions to its liquid phase when the pressure is increased to over 5.73 MPa (830 psi). Other examples of fluids that may be employed in the present invention include, but are not limited to carbon dioxide, methane, propane, butane, argon, nitrogen, ammonia, water, many fluorocarbons and hydrocarbons. Some of these supercritical fluids may require higher pressures, higher temperatures or greater care in handling.

The terms "supercritical fluid/liquid" as used herein refer to a fluid at conditions of pressure and temperature that is in its liquid or mostly liquid form at conditions preceding entrance into the nozzle (to be described). This condition of temperature and pressure may or may not be above the critical point of the fluid. The terms will also mean a fluid at conditions of pressure and temperature after exit from the nozzle primarily in the gaseous form.

The supercritical fluid is used in the present invention to transport fine particles (typically on the order of 250 to 450 microns in size) including but not limited to quartz sand, garnet abrasive, steel abrasive, or any combination thereof.

The inventive abrasive jet-assisted cutting or drilling method includes the steps of: 1) providing an abrasive-laden supercritical fluid/liquid under a predetermined and controlled pressure and temperature, wherein the abrasive-laden supercritical fluid/liquid comprises a suspending of a pre-selected amount of abrasive solids in a pre-selected supercritical fluid/liquid, 2) delivering said abrasive-laden supercritical fluid/liquid to a cutting nozzle capable of accelerating said abrasive solids, wherein said abrasive-laden supercritical fluid/liquid is discharged out of said nozzle as an abrasive jet stream carried by gas, low-density supercritical fluid, or a mixture of both, and 3) discharging said abrasive jet stream at a target substance.

Optionally, the method may further include the step of controlling pressure or temperature at said cutting nozzle, so that said supercritical fluid/liquid expands to its gas phase at or within the cutting nozzle or at discharge. Moreover, when employing the inventive method in a drilling operation, the method may include another optional step of creating a hole with said abrasive jet stream at said target substance, whereas said hole is sufficiently large to accommodate said nozzle or its attachment before advancing further in the target material.

It is important that the supercritical gas be at a pressure and temperature so it is a liquid when carrying abrasive solids before the nozzle. Since gas has a lower velocity and carrying capacity, the solids may drop out or at least erosion by the moving solids will increase. It is also important that the supercritical gas be liquid when being pumped since the efficiency of pumping a liquid is much more efficient than pumping or compressing a gas. In fact, the higher pressures desired in abrasive cutting with supercritical fluids cannot easily be obtained by a pump if it is a gas. To accomplish this requirement, the following steps are required.

When providing the abrasive-laden supercritical fluid/liquid, the abrasive solids may be premixed with the supercritical fluid/liquid (also called the carrier fluid), which is then pumped into the delivery line to the nozzle. One non-limiting example may be appreciated from the following:

1. Cool a pump or batch tank and an inlet/suction pipe as needed prior to pumping supercritical fluids to keep it as a liquid through the pumping process;
2. Maintain the inlet pressure above the pressure needed, at the operating temperature, to keep the supercritical fluid as a liquid through the pump/tank;
3. Pump water or another incompressible fluid through the pump prior to pumping supercritical liquids so that the pump and discharge line to the nozzle is above that pressure to keep the gas as a liquid;
4. Optionally begin pumping/discharging supercritical gas as a liquid without abrasives;
5. Start abrasives addition to the supercritical fluid or stream.

Supercritical fluid/liquid can be utilized for abrasive cutting by increasing its pressure through any means of displacement, including positive displacement pumps (piston or plunger types), tanks (batch), and other means. Batch systems allow solids and incompressible liquids/chemicals to be added to the tank batch prior to adding the supercritical fluid/liquid, with the pressure in the tank building up to or starting at that pressure for the liquid state. Mixing would have to occur prior to release. Release of the supercritical fluid/liquid and solids, as a slurry, could then occur with additional liquid or a gas displacing the slurry out of the tank toward the nozzle at a near constant pressure. Conversely, the pressure could start much higher and allow the pressure to decline to a point where supercritical fluid/liquid still exists in the tank. In batch or pump modes, the concerns expressed earlier in keeping the liquid state still apply.

When shutting down the process, it is important to not stop pumping/displacing the supercritical fluid because, if the nozzle is open, the supercritical fluid will eventually flash to a gas at the point where the pressure drops to below what is needed to keep it as a liquid at the existing temperature. If it has solids in it, they may fall out and plug up the pipe or nozzle hole. Thus, it is important to convert to an incompressible fluid (for example, water or oil) and pump/displace that fluid at least until the nozzle is clear. Thus, the steps to follow on shutdown are:

1. Stop pumping abrasive slurry;
2. Convert to pumping/displacing an incompressible fluid;
3. Continue pumping until the nozzle, at least, is clear of supercritical fluids and solids.

In the event that the nozzle plugs up, it is important to have a pressure relief valve or burst plate between the pump/tank and the nozzle. That relief valve/plate should be directed to release back flow fluids and solids toward a safe direction.

Alternatively, the abrasives may be introduced into the stream of supercritical fluid/liquid at pressure. Typically, the abrasive is mixed in a ratio between about 5 to 20% by weight of abrasive particles within the carrier fluid.

During the delivering step, the carrier fluid is maintained in its supercritical/liquid phase to hold or carry the abrasive solids or particles to the cutting nozzle. While carrying the abrasives, the carrier fluid gradually transfers its kinetic energy (i.e., velocity) to the abrasives. When reaching the cutting nozzle, the energy transfer gets accelerated by the nozzle design (described later) and magnified by the fact that the supercritical fluid/liquid is expanding into its gas or its low-density supercritical phase.

At discharge, the abrasive jet stream is discharged into an environment with normal atmosphere or with relatively low pressure, without the need of artificially maintaining a high-pressure environment such as in a prior art operation. At normal atmosphere or with relatively low pressure, the supercritical fluid/liquid expands into its gas phase, which further accelerates the abrasive jet stream.

A similar effect may be made by maintaining a liquid level or 'head' down stream of the nozzle or by a choke at the surface. Both a choke and fluid level can be combined for an increased effect. When employing the method in a deep earth drilling operation, an optional step of controlling pressure and/or temperature at discharge may be adopted. Specifically, the pressure before the cutting nozzle may be controlled by regulating the rate and pressure from the pump and in sizing the nozzle diameter. The pressure after the nozzle can be controlled by selection of the fluids, choking the flow from the target area downstream of the nozzle or a combination of all means.

The temperature also may be controlled by upstream refrigeration of the fluids, or downstream or in-nozzle heating to ensure gas formation. Sufficient heating of the nozzle can ensure flashing of liquid carbon dioxide or other liquids to gas while in the nozzle section or immediately at discharge from the nozzle.

Employing a supercritical fluid/liquid as the carrying fluid, instead of pressurized water as in the prior art, provides the further advantage of clearing the cutting/drilling area of the cuttings and spent material in addition to providing a low density path to the target cutting zone. For example, the supercritical fluid/liquid carbon dioxide transitions into the gaseous carbon dioxide at discharge, in the larger volume of the transition, the gaseous carbon dioxide (the spent fluid) has enough kinetic energy to "escape" flow (around the abrasive jet stream) between the annulus and the rock wall to carry the spent abrasive and cutting/drilling debris out of the cutting zone and up the hole. When the inventive method is employed in a drilling operation in a deep borehole, the pressure may remain high and keep the supercritical fluid wholly or partially as a low-density supercritical fluid. However, the low-density supercritical fluid by design would reduce interference of the abrasive jet stream and would still flow to the surface carrying all the cut debris. While flowing to the surface, the low-density supercritical fluid will eventually turn fully into its gas phase at sufficiently low temperature and pressure so as to operate as described above for gaseous carbon dioxide carrying the spent abrasive and cutting/drilling debris out of the hole.

Utilizing supercritical fluids/liquids carrying abrasive solids as a cutting or drilling fluid in the inventive method offers many advantages. First, in the process of discharging from a cutting nozzle, the supercritical fluid/liquid's transformation or expansion from its supercritical/liquid phase into its gas or low-density supercritical-fluid phase will greatly accelerate the desired energy transfer between the supercritical fluid/liquid and the carrying abrasive solids to form a powerful abrasive jet cutting or drilling stream at discharge. Second, gas or low density fluid would allow for a clear path and less interference with the cutting stream to the target area. Third, after discharging from a cutting nozzle and during the cutting or drilling operation, the gas or low-density supercritical-fluid will continuously flow to the surface while bringing most of cutting/drilling debris and spent abrasives with it. Fourth, by the design of the inventive method and apparatus, the abrasive jet stream may cut/drill through an area wider than the cutting nozzle (and nozzle assembly) to avoid the need of line and equipment rotations during a cutting/drilling operation.

To aid in delivering abrasives, solids and target rock materials to the surface, water, oils, surfactants, and polymers may be added to the delivered stream as discussed in detail below.

The inventive cutting or drilling method may be applied in cutting through or drilling into any rock found on the Earth or other planet or other body in space, for exploration, testing, evaluation or production. For example, shale, sandstone, siltstone, limestone, dolomite, basalt and volcanic flows are all encountered during drilling operations in the Earth. Many of these rocks on earth are called 'sedimentary' and require water for initial deposition. Other planets and bodies may have only molten materials that have cooled and solidified, and may be called 'igneous or metamorphic rocks'. These 'rocks' can be of any number of materials, but would be more similar to volcanic flows on earth. Mars, for example, has basalt as the main rock—a material drilled in the supporting research to this application.

The inventive cutting or drilling method may be applied in a shallow surface cutting or a deep surface drilling operation. Surface cutting would include applications in job, machine or fabrication shops where the abrasive system is focused on materials to linearly cut into parts. Other applications of the inventive abrasive cutting method may be for demolition of existing facilities, such as pipelines and tanks/vessels. Other such applications include trenching, mining, and roadway or pipeline boring.

Figure 2:
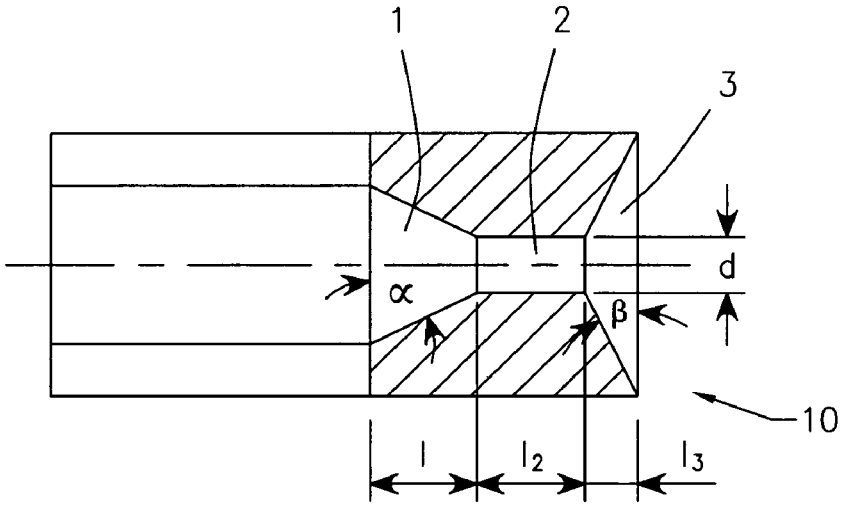
FIG. 2 illustrates the inventive cutting nozzle, according to one embodiment of the invention.

Referring to FIGS. 1 and 2, FIG. 1 is a prior art cutting nozzle, while FIG. 2 illustrates a detailed view of one embodiment of the present invention. One drawback of a conventional fan shaped nozzle (of the type used, for example, in a car wash) is that the design leaves a thin metal thickness at the orifice to give a sharp edge for best jet production. The thin layer is very vulnerable to wear and tear when used with a water jet which contains abrasive, so that the functional lifetime of a conventional nozzle is measured in minutes.

The inventive cutting nozzle shown in FIG. 2, when employed in the inventive cutting or drilling method with an abrasive-laden supercritical fluid/liquid, can generate a gas (or low-density supercritical fluid) forming an abrasive jet stream with wide conic jet angle. The cutting nozzle 10 in FIG. 2 includes three connected sections. The first section is the inlet converging conic section 1, with a converging angle, $\propto$, ranging from about 5 to about 90 degrees. The overall length of this section $l_1$, is controlled by the diameter of the feed tube to which it attaches, and which provides the inlet diameter, and the size of the throat into which the conic section feeds the fluid.

The throat section 2, is designed to have a constant but narrow diameter, d, ranging from 0.2 to 5 mm and is of relatively short length $l_2$, compared with the conventional abrasive cutting nozzle, which ranges from 25 to 150 mm or longer, depending on the overall flow rate and pressure desired. The throat section 2 flows to the diverging conic discharge section 3, with a diverging conic angle, $\beta$, ranging from 10 to 90 degrees. The depth $l_3$, of the discharge section 3, is controlled by the divergent angle, the exit diameter of the throat section of the nozzle and the final diameter required for the hole to be drilled.

The design of the inventive cutting nozzle facilitates the pre-suspended abrasive-laden supercritical fluid/liquid while traveling through the nozzle to accelerate in both speed and directional velocity, focusing the jet stream, expanding, in whole or in part, the supercritical fluid/liquid into its gas phase (or low-density supercritical fluid), and the consequent discharge into a desired gas-carrying (or low-density supercritical-fluid-carrying) abrasive jet stream with wide conic angle.

Particularly, the inlet section 1, with its desirable converging angle, restricts the flow volume of the abrasive-laden supercritical fluid/liquid admitted from the feeding line, and thus increases the velocity of the supercritical fluid/liquid and promotes the energy transfer from the supercritical fluid/liquid to the abrasive particles.

The throat section 2, with its narrower channel, further restricts the flow volume, increases the velocity, and focuses the jet stream to be produced. It provides a restriction to the incoming flow that holds the pressure in the line upstream of the throat at a level that retains the carrier fluid as a supercritical fluid/liquid. The length of the throat section provides a focus to contain the carrier fluid during this transition and to allow the focusing jet stream to be generated and facilitating energy transfer from the carrier fluid to said abrasive particles to accelerate the velocity of said abrasive particles. While the bore of this section is generally considered cylindrical, the bore may also taper out in a diverging manner towards the exit (the discharge section 3) at an angle between 0 to about 5 degrees. The liquid may transfer into its gas or low-density supercritical fluid phase within the throat section 2.

As the accelerated abrasive particle stream carried by the supercritical fluid/liquid flows into the discharge section 3, the supercritical fluid/liquid further expands into its gas phase (or low-density supercritical fluid in a deep borehole operation). The dramatic increase in volume is contained by the diverging wall of the nozzle further accelerating the velocity of the abrasive jet stream and transferring an increasing level of energy to the abrasive particles. The diverging walls also control the shape of the discharging abrasive jet stream to cut to the desired diameter in the target material.

By discharging said abrasive jet stream with further accelerated velocity and over a wide, but controlled, jet angle, all the material ahead of the conic section is attacked and removed by the abrasive particles. The outer edge of the divergent cone may be set for the largest diameter that the hole is intended to be cut. By this method, the nozzle is held in position with the abrasive cutting over the surface ahead of the conic section, by the outer diameter of that section, until the required clearance has been achieved. By holding the nozzle in this position, the cut material and spent abrasive and gas are also directed to flow out beyond the cone to return up the bore of the drilled hole to the surface. In this way the flow path inhibits interference with the attacking jet and particles limiting the reduction in performance through rebounding jet interference. The expanded gas or low-density supercritical fluid phase of the carrying fluid also provides a transport means by which the spent material is carried to the surface through the drilled bore.

For even larger cut/drilled hole sizes, multiple nozzles of the present invention can be mounted on a fixed or rotating head.

Figure 3A:
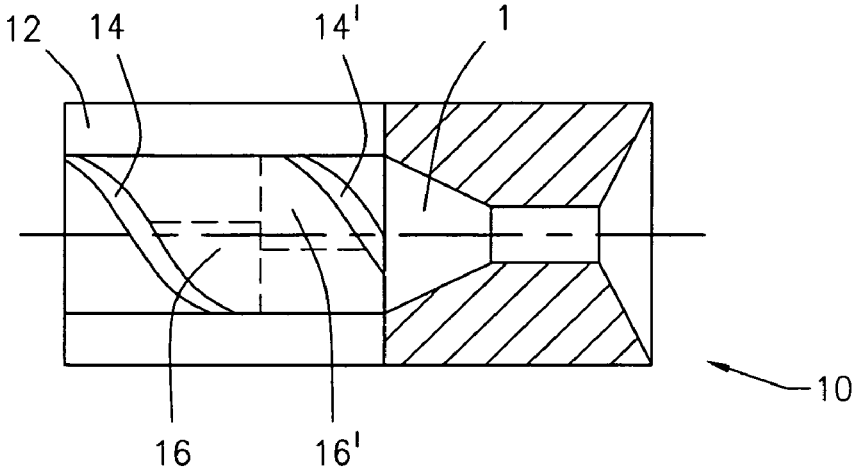
FIG. 3A illustrates the nozzle assembly including the feeding section with swirling vanes and cutting nozzle, according to one embodiment of the invention.
Figure 3B:
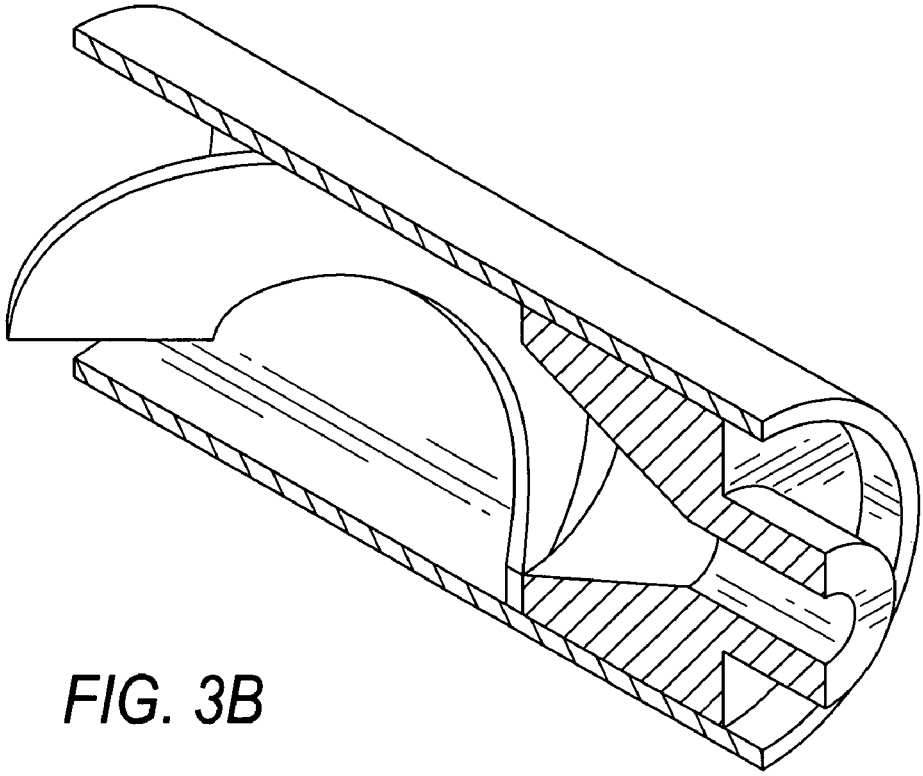
FIG. 3B is a perspective view of the nozzle assembly shown in FIG. 3A.

Referring to FIGS. 3A and 3B, an inventive nozzle assembly 20 is illustrated having a feeding section 12, and a cutting nozzle 10, with its inlet section 1, abating the end of the feeding section 12. A pair of fluted slits 14 and 14' cuts through the wall of the feeding section in a pre-arranged orientation varied by applications. A blade assembly, such as a pair of blades (also known as swirling vanes) 16 and 16', can be placed in the respective slit 14 and 14'. In order for these blades to resist the high velocity of the abrasive particles in this restricting section of the nozzle, the materials of the vanes can be of a pair of resistant carbide or may be of a polycrystalline diamond compact coated surface. FIG. 3B is a perspective view of FIG. 3A. While a pair of blades is illustrated in FIGS. 3A and B, a multiplicity of blades may be used.

The turning vanes act on the flowing stream into the nozzle such that the slurry mixture begins to spin around the axis of flow, and the nozzle assembly. This spinning action is carried into the throat of the nozzle, and thus imparts a wide variation in ultimate direction of velocity of individual particles at the exit of the nozzle, thereby directing them over the face of a large and dispersed circle, rather than being confined within the diameter of the nozzle throat, as the particles leave the nozzle.

Figure 4:
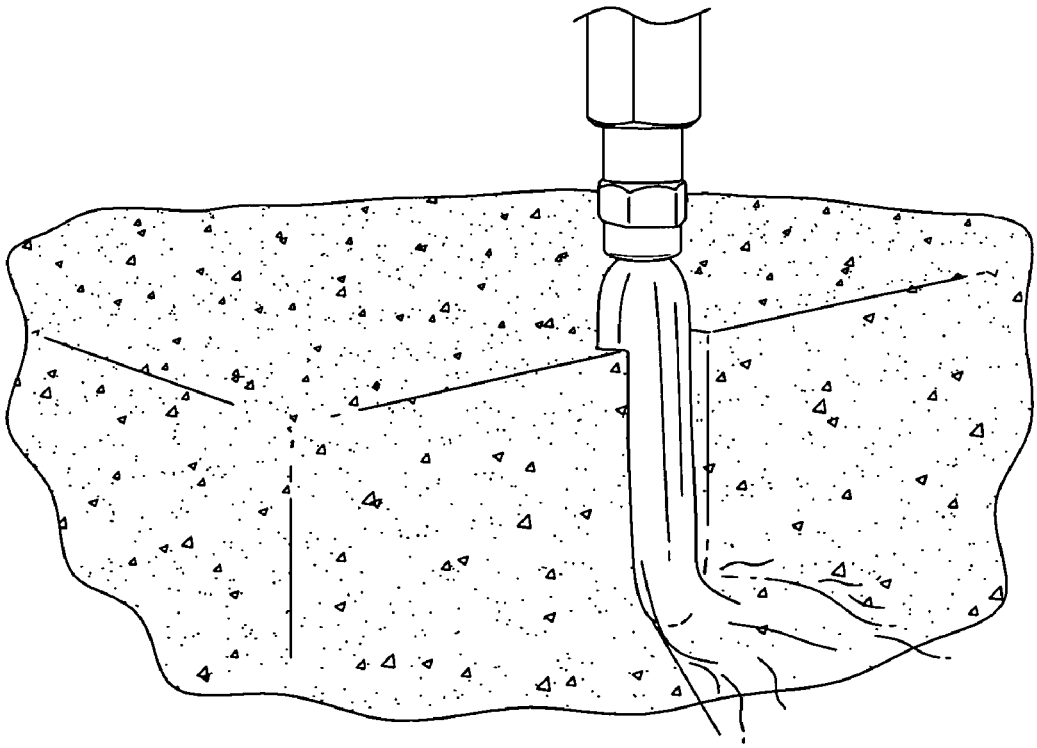
FIG. 4 illustrates an exemplary drilling in rock using the embodiment of the invention where the abrasive is mixed with and accelerated by the supercritical fluid and its transition largely to gas, but without turning vanes.
Figure 5:
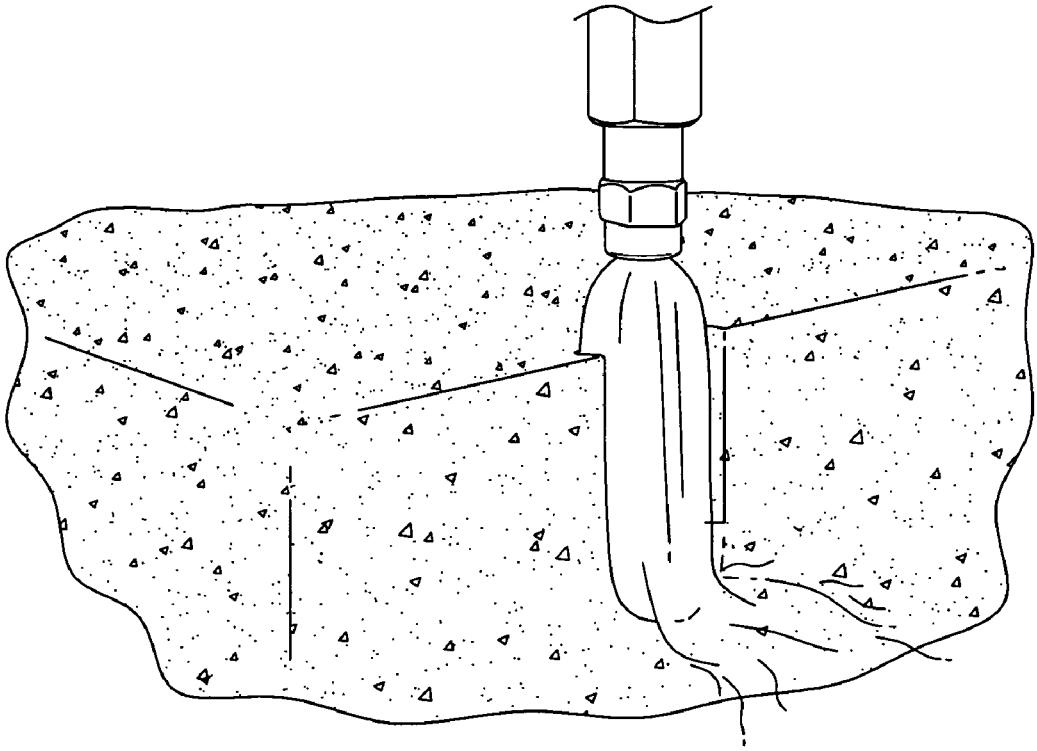
FIG. 5 illustrates an exemplary drilling in rock, using the same configuration as FIG. 4 except that turning vanes or blades have been used in the nozzle to swirl the jet, and generate a broader cutting stream—part of the diverging conic section of the nozzle has not been used in FIGS. 4 and 5, and the drilling operation located on the side of the rock, so that the shape of the hole being generated can be seen.
Figure 6:
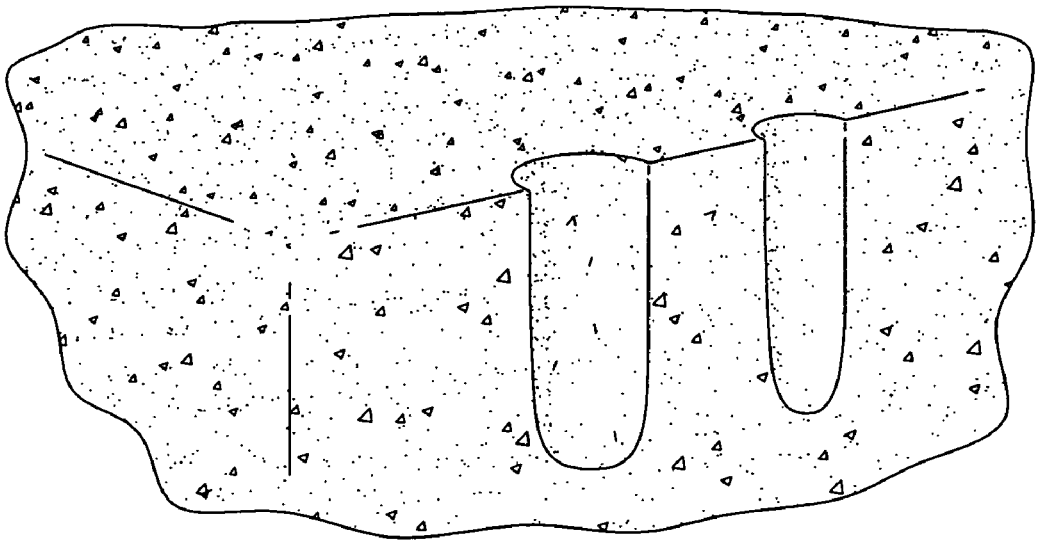
FIG. 6 shows the hole as being drilled in FIG. 5, in comparison to that in FIG. 4.
Figure 7:
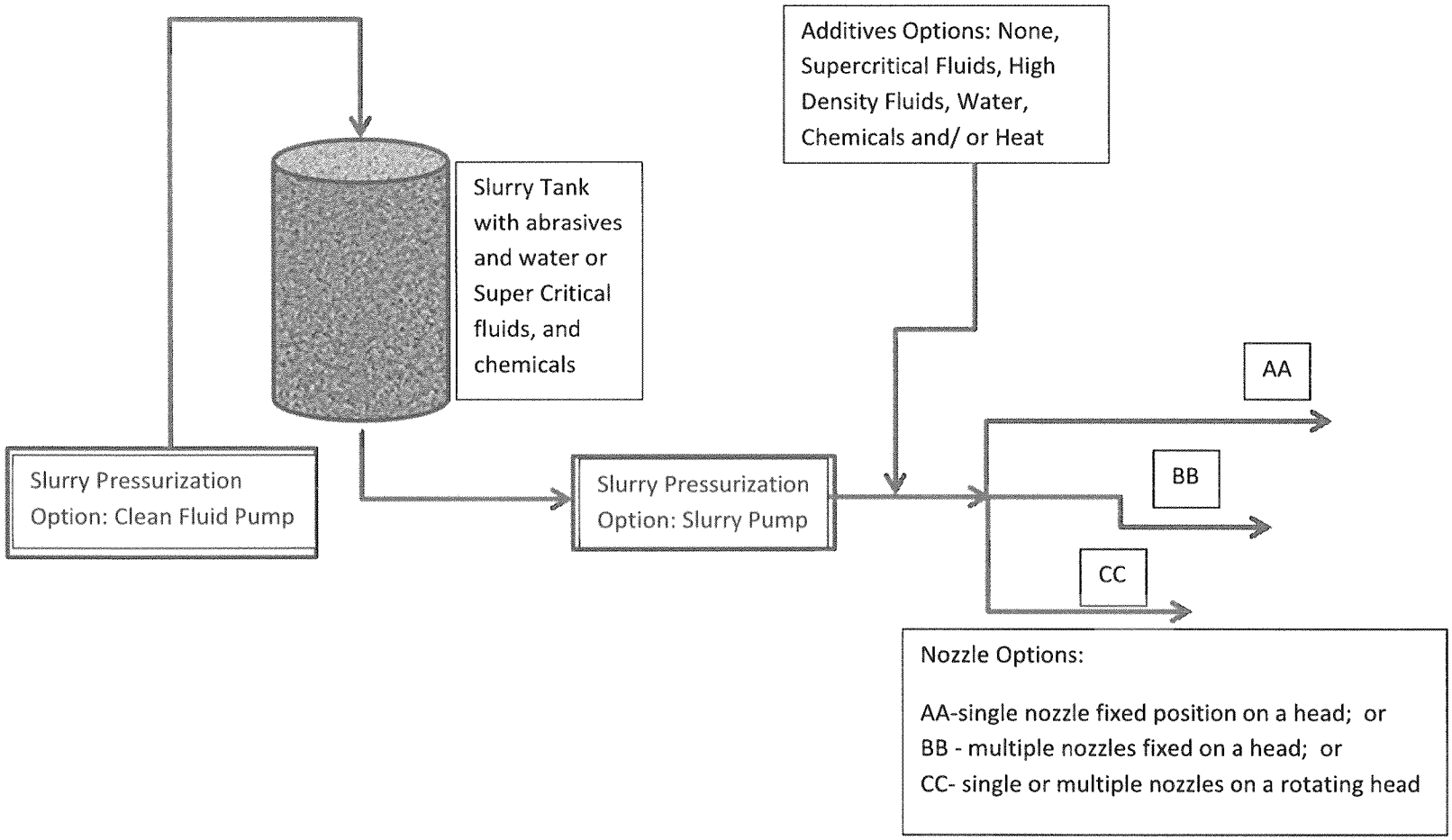
FIG. 7 shows the inventive system of cutting or drilling.

Referring to FIGS. 4 through 6, the invention provides several rock drilling examples using the inventive method and apparatus, in which a supply of liquid carbon dioxide and abrasive solids are fed, under a pressure of 30 MPa through a nozzle of the present invention that is approximately 1 mm in diameter at the throat. In order to demonstrate the process "in action" the diverging cone on the downstream side of the throat section has not been used in these tests, so that the expanding nature of the gas leaving the throat section can be witnessed.

From this discussion and these examples, it should be clear that many combinations and designs of accompanying sections with the restrictive throat section can be utilized.

Various additives may be introduced to the supercritical fluid/liquid before passing through the nozzle. For example, foaming agent additives may be introduced such as dodecyl sulfates or xanthan gum. Foamer additives can assist in helping clean the drilled hole of cuttings and abrasives so that the drilling process can continue. Foamer additives might also help remove water or other liquid influx from the well bore.

Additionally, various surfactants for foaming carbon dioxide gas may be added including cationic surfactants (based on quaternary ammonium cations), anionic surfactants (based on sulfate, sulfonate or carboxylate anions), and zwitterionic surfactants (amphoteric).

Possible additional chemical additives for retaining or holding solids in liquid carbon dioxide prior to introduction to the nozzle include xanthan gum, water, oils and other chemicals.

While the invention has been described in connection with specific embodiments thereof it will be understood that the inventive methodology is capable of further modifications. This patent application is intended to cover any variations, uses, or adaptations of the invention following, in general, the principles of the invention and including such departures from the present disclosure as come within known or customary practice within the art to which the invention pertains and as may be applied to the essential features herein before set forth and as follows in scope of the appended claims.

Whereas, the present invention has been described in relation to the drawings attached hereto, it should be understood that other and further modifications, apart from those shown or suggested herein, may be made within the spirit and scope of this invention.

What is claimed is:

1. A method of cutting or drilling comprising the steps of:

providing an abrasive-laden primarily liquid or high density supercritical fluid under predetermined pressure and temperature, wherein said abrasive-laden primarily liquid or high density supercritical fluid comprises a suspension of said abrasive particles in said abrasive-laden primarily liquid or high density supercritical fluid;

delivering said abrasive-laden primarily liquid or high density supercritical fluid to a nozzle;

increasing velocity of said abrasive-laden primarily liquid or high density supercritical fluid as it passes through a flow-restriction in said nozzle;

beginning expansion of said primarily liquid or high density supercritical fluid into its gaseous or low-density state as it passes through said nozzle;

transferring kinetic energy from said expanding fluid to said abrasive particles to accelerate velocity of said particles; and discharging a gas-carrying or low-density supercritical-fluid-carrying abrasive jet stream containing abrasive particles from said nozzle.

2. The method of claim 1 wherein said primarily liquid or high density supercritical fluid is chosen from the group consisting of carbon dioxide, water, nitrogen, propane, butane, freon, and methane.

3. The method of claim 1 including the additional step of introducing an additive to the primarily liquid or high density supercritical fluid and abrasives prior to delivering to the nozzle.

4. The method of claim 3 wherein said additive is a foaming agent.

5. The method of claim 3 wherein said additive is a surfactant.

6. The method of claim 3 wherein said additive is a polymer.

7. The method claim 3 wherein said additive is water.

8. The method of claim 3 including the additional preliminary steps of making a batch of abrasive slurry in a tank and discharging said slurry through a delivery line then adding primarily liquid or high density supercritical fluid to the slurry.

9. The method of claim 1 wherein the abrasive jet stream is directed against a target substance that may comprise any material on the Earth, other planet, or body in space.

10. The method of claim 1 wherein said step of delivering said abrasive-laden supercritical fluid/liquid to a nozzle and passing through said nozzle includes delivering said abrasive-laden supercritical fluid/liquid to multiple nozzles arrayed on a single head and passing through said multiple nozzles.

11. The method of claim 10 wherein said single head rotates about an axis.

12. The method of claim 1 including an additional preliminary step of preparing an abrasive particle slurry in a liquid before adding it to a supercritical fluid.

13. The method of claim 1 including the additional step of controlling rate of expanding said primarily liquid or high density supercritical fluid by passing through a diverging section of said nozzle.

14. The method of claim 1 wherein the flow is directed first through a converging section of the nozzle, followed by a straight bore section, followed by a diverging section of the nozzle.

15. A method of cutting or drilling comprising the steps of:

providing an abrasive-laden primarily liquid or high density fluid under predetermined pressure and temperature, wherein said abrasive-laden fluid comprises a suspension of said abrasive particles in said fluid;

delivering said primarily liquid or high density abrasive-laden fluid to a nozzle;

increasing velocity of said abrasive-laden fluid as it passes through a flow-restriction in said nozzle;

expanding said fluid into its gaseous or low-density state as it passes through said nozzle;

transferring kinetic energy from said expanding fluid to said abrasive particles to accelerate velocity of said particles; and discharging a gas-carrying or low-density fluid-carrying abrasive jet stream containing abrasive particles from said nozzle.

16. The method of claim 15 wherein the flow is directed first through a converging section of the nozzle, followed by a straight bore section, followed by a diverging section of the nozzle.

17. The method of claim 1 including the additional preliminary step of introducing an additive to said abrasive-laden primarily liquid or high density supercritical fluid.

* * * * *